US006789599B2

(12) United States Patent
Schütz et al.

(10) Patent No.: US 6,789,599 B2
(45) Date of Patent: Sep. 14, 2004

(54) DOOR DRIVING-MECHANISM TORQUE TRANSMISSION, MOTORIZED DOOR DRIVING MECHANISM PROVIDED THEREWITH, AND DOOR PROVIDED THEREWITH

(76) Inventors: Herr Viktor Schütz, Brusselhain 13, D-59755 Arnsberg (DE); Herr Michael Sanke, Hellweg 78, D-33378 Rheda-Wiedenbruck (DE)

( * ) Notice: Subject to any disclaimer, the term of this patent is extended or adjusted under 35 U.S.C. 154(b) by 62 days.

(21) Appl. No.: 10/105,127

(22) Filed: Mar. 15, 2002

(65) Prior Publication Data

US 2002/0129907 A1 Sep. 19, 2002

(30) Foreign Application Priority Data

Mar. 19, 2001 (DE) ..... 101 13 229
Mar. 23, 2001 (DE) ..... 101 14 288
May 14, 2001 (DE) ..... 011 11 691

(51) Int. Cl.[7] ..... E05F 15/16
(52) U.S. Cl. ..... 160/188; 474/113
(58) Field of Search ..... 160/188, 310; 248/332, 333; 474/113, 117, 134; 74/574, 473.29

(56) References Cited

U.S. PATENT DOCUMENTS 3,575,058 A * 4/1971 Kraus ..... 474/29
4,840,330 A * 6/1989 von Broock ..... 244/17.27
2002/0086752 A1 * 7/2002 Friedrich et al. ..... 474/148

FOREIGN PATENT DOCUMENTS

EP 0405059 * 5/1989
WO WO 94/00665 * 6/1993

* cited by examiner

*Primary Examiner*—Blair M. Johnson
(74) *Attorney, Agent, or Firm*—Max Fogiel

(57) ABSTRACT

A door driving-mechanism torque transmission (20, 40, or 50) for transmitting torque from a door-driving motor assembly, especially a geared motor (36), to a shaft (33) connected to a door panel (31). A driving component rotates around an axis and can be engaged with the door-driving motor assembly. A driven component rotates around another axis and can be engaged with the shaft. A bearing assembly accommodates both components mounted on separated axes of rotation. There is a coupling connection (2) between both components.

The object is to promote smooth operation and decrease frequency of repair.

The bearing assembly (4 or 51) is accordingly provided with a driving-component bearing half (5 or 52) that the driving component (1) is mounted on and with, separated therefrom, a driven-component bearing half (6 or 53) that the driven component (3) is mounted on. The bearing halves (5 & 6 or 52 & 53) are connected elastically for the purpose of attenuating torsional vibrations and impacts.

The invention also concerns a motorized door-driving mechanism provided with such a torque transmission as well as a door provided therewith.

15 Claims, 4 Drawing Sheets

DOOR DRIVING-MECHANISM TORQUE TRANSMISSION, MOTORIZED DOOR DRIVING MECHANISM PROVIDED THEREWITH, AND DOOR PROVIDED THEREWITH

BACKGROUND OF THE INVENTION

The present invention concerns a door driving-mechanism torque transmission for transmitting torque from a door driving motor assembly, especially a geared motor, to a shaft connected to a door panel. A torque transmission, a door-driving mechanism, and a door of these genera are known from WO 94/00665, which will be discussed in detail hereinafter.

A door panel with a door-driving motor assembly is known from EP 0 405 059 A1. Interposed between its output shaft and a door drive-mechanism torque transmission in the form of a door shaft that secures and/or actuates the panel are a tractioning-means transmission with a driving component in the form of a transmission input shaft and a driven component in the form of a transmission output shaft. Both components are accommodated in an accommodation constituted by a transmission housing. The housing comprises two identical halves fastened rigidly together and accommodating the tractioning-means transmission. The transmission housing and hence the overall transmission on the whole rotate perpendicular as a whole to the parallel axes of rotation of the transmission shafts, the transmission-input shaft and the transmission output shaft, that is, around the axis of the door shaft and can be pivoted subject to reaction forces exerted by the panel being actuated against a shock absorption component and/or a resilient component in the form of a spring. The door-driving motor assembly rests on the transmission input shaft and is accordingly connected to the housing. The initial motion of the door-driving motor assembly generates an impact-like force (torque impact) that is on the whole resiliently accommodated by the pivoting motion of the known door driving-mechanism torque transmission against the resilient component. This pivoting motion is also exploited for an overload disengagement mechanism.

With the prior art disclosed in European Patent 0 405 059 A1 as its point of departure, the aforesaid WO 94/00665 proposes an improvement in the form of a door driving-mechanism torque transmission.

This known transmission is, like the one disclosed in WO 94/00665, a tractioning-means transmission and part of a mechanism for driving a door panel. The panel is provided with a door shaft coupled to it. The output shaft of a door-driving motor assembly accommodated in a driving-mechanism housing is connected to the door shaft by way of the tractioning-means transmission, which is accommodated in a transmission housing. The known door driving-mechanism torque transmission has a driving component in the form of an input shaft connected to the door-driving motor assembly's output shaft and a driven component in the form of an output shaft connected to the door shaft. The axes of rotation of the input and output shafts are separated by a multiple of the radii of gear wheels mounted on the shafts and coupled together by the tractioning means. The driving-mechanism housing of the door driving motor assembly is fixed in position and rotates along with the transmission housing and hence with the door driving-mechanism torque transmission on the whole in such a way that any torque between the door shaft and the door driving motor assembly's output shaft is accommodated as if by a rigid lever.

SUMMARY OF THE INVENTION

The object of the present invention is accordingly to improve a door driving-mechanism torque transmission with respect to smooth operation, length of life, and frequency of repair.

Instead of a rigid torque-transmission housing that transmits torque like a single-arm lever accordingly, the present invention exploits a bearing assembly with two separate halves, one for the door driving-mechanism torque transmission's driving component and one for its driven component. Since these halves are connected together not rigidly but elastically, they will attenuate any impacts or vibrations in the torque they transmit between the driving component and the driven component. Both components are accordingly elastically connected such that they can move toward or apart from each other and especially pivot in relation to each other at least slightly (a few millimeters, 0.5–5 mm for example) preferably within the plane occupied by at least one.

The torsional impacts exerted on the door-driving motor assembly and its fixtures in the torque transmission in the form of a rigid lever considered especially preferred in WO 94/00665 are admittedly attenuated by being transmitted over a long lever. The impacts, however, must be accommodated by the torque-transmission train as a whole, and this has resulted in breakage of the weakest components therein, like the shaft coupling between the door driving-mechanism torque transmission and the door shaft for instance, which must then be replaced. The door driving-mechanism torque transmission in accordance with the present invention will also run more smoothly than the known transmission, not only when started and with the torsion impact to be expected at that instant but also while the door panel is in motion. The door shafts available in practice, that is, almost never rotate trues, not only because they naturally exhibit considerable imbalance due to the engagement of the torsion spring, the overhead door armor, or similar structures but also because the forces exerted on them vary constantly as the shaft turns. Furthermore, the door shafts available in practice are also absolutely more powerfully inflected. All of these problems result in more or less powerful vibrations both circumferentially and axially, which are accommodated in accordance with the present invention by relatively small unresilient masses (only the driven-component bearing being exposed more or less unresiliently to impacts deriving from the door shaft), and these are in any case transmitted attenuated to the driving-component bearing half and hence to the door-driving motor assembly by way of the elastic attachment.

When torsion impacts occur, accordingly, it is not the door driving mechanism as a whole, comprising, that is, the door driving motor assembly and the door driving-mechanism torque transmission, that yields elastically as at the prior art represented by EP 0 405 059 A1, but only the bearing halves, toward each other, avoiding the drawbacks encountered in the door driving-mechanism torque transmission disclosed in that patent, which are in particular expressed in the difficulties associated with its manufacture and installation. The number of masses that accompany such torsion impacts without being resiliently supported is also much lower in accordance with the present invention than at the aforesaid state of the art, which not only contributes to smooth operation but also helps to prevent damage deriving from impacts against the door driving motor assembly. The present invention accordingly combines all the advantages of the known door driving mechanism torque transmission while lacking its drawbacks.

In one advantageous embodiment of the present invention, both bearing halves can be elastically connected together at any desired distance apart. The door driving-mechanism torque transmission can accordingly be adapted to span various distances between the door-driving motor assembly and the door shaft. This feature increases the range of possibilities for installing the assembly.

When both bearing halves are elastically connected such that they can move straight or at an angle toward and away from each other at least within a plane perpendicular to at least one of the two axes of rotation, especially the axis of the driven component, torsional vibrations around that axis can be attenuated by a relative elastic pivoting motion. A connection that permits such relative angular motions can be established in various ways. The bearing halves can for instance be connected by a pivot or by a joint (even a ball joint), the pivoting motion occurring against some sort of elastic component, a compression or tension spring for example, or a rubber block, a rotating rod, or a torsion spring. When the bearing halves are elastically connected at at least two separated points of attachment, not only motions around one axis, but also translational motions on the part of the bearing halves toward and away from each other can be attenuated by the elastic connection at the points of attachment even though the attachment is sufficiently fixed at the two points to actually transmit the requisite torque. Thus, even impacts and vibrations that occur radially with respect to an axis of rotation due to wobbling of the door shaft can be attenuated.

Several separated points of attachment can be established by means of an elongated elastic component, a rubber strip for example, by way of which the bearing halves can engage surface to surface or linearly. It is, however, preferable for the points of attachment to comprise separated connecting blocks or liners of an elastic material, by way of which the two bearing halves are connected.

One of the bearing halves can in this event be provided with pins that engage a connection bushing in the form of a rubber bushing and the other with fixtures, cylindrical for example, that surround or enclose the rubber bushings. The rigidity and attenuating characteristics can, directionally as well, be varied as desired by varying the positions, directions, and material of the connection bushings (by varying the Shore hardness and/or width of the rubber bushings), relatively as well. One advantageous embodiment of the present invention accordingly, is characterized by an assortment of elastic components for connecting the two bearing halves together and having different elastic properties, especially deriving from different hardnesses and/or from such various dimensions as outside diameter, and allowing specific adjustment of rigidity and/or torsional-vibration attenuation characteristics in accordance with which particular components are selected from the assortment.

The bearing halves can be of any form appropriate for accommodating the components and for connecting them such that torsion impacts and other impacts and vibrations in the driving train can be absorbed. They can for example comprise flat stamped-out shapes or lengths of structural section etc. with a component-bearing area and a connecting area, with the coupling between the components covered by an additional protective enclosure, which can be in several parts for example and which can be of plastic for example. Such an additional enclosure, however, will be unnecessary when both bearing halves are elastically coupled, and especially mutually telescopically engaging such as to allow relative angular motion with play, individual components of a torque transmission housing, preferably such that each essentially comprises two especially identical and mutually connected housing shells.

The coupling itself can be of various forms. A cogwheel coupling or universal joint would be possible for example. The maximal degree of freedom with respect to the distance to be spanned and to how the bearing halves move in relation to attenuation, however, is provided, as at the aforesaid state of the art, in an embodiment wherein the coupling is in the form of at least one continuous tractioning means, a chain, cogged band, or belt for example, whereby each half is provided with a wheel that engages the at least one means mechanically or frictionally.

In this event it will be preferable for a tractioning-means transmission comprising the at least one tractioning means and both wheels is enclosed in the shells that comprise the torque-transmission housing whereby in particular tensioning means draw the two strands of the tractioning means together inside the transmission housing.

In one advantageous embodiment of the door-driving mechanism in accordance with the present invention, the driving component bearing half is fastened to a stationary driving mechanism housing for the door-driving motor assembly, especially extending in any desired direction, whereby, however, the driving-component bearing half is elastically disengaged from the driving-mechanism housing due to the elastic connection between the two bearing halves for the purpose of attenuating torsional vibrations. It is accordingly only the driven-component bearing that vibrates in tune with torsional or radial vibrations in the door shaft. The driving-component bearing half is uncoupled therefrom and fastened stationary due to the connection with the stationary driving-mechanism housing. This arrangement decreases noise and prevents damage from impacts.

It would in principle alternatively be conceivable to cushion the bearing-halves connection with a viscous fluid or with gas in addition to or instead of an elastic solid. In addition to an elastic connecting component, a friction component that would provide frictional attenuation and/or a liquid shock absorber could be inserted between the bearing halves to attenuate vibrations. In principle, the two bearing halves or the two components of the door driving-mechanism torque transmission or even both could be connected by any devices known for example from the field of torsional vibration shock absorbers employed in motor-vehicle couplings or motor-vehicle running gear, specifically dashpots, proportional shock absorbers, etc.

The present invention especially relates to a door driving mechanism torque transmission of the genus known from WO 94/00665. Reference is specifically directed to that publication; and to EP 0 405 059 A1 for any details of the invention not explained herein.

Instead of a transmission housing in the form of a rigid lever fastened to the driving-mechanism housing, the door driving-mechanism torque transmission in accordance with the present invention features driving and driven components that are preferably both circumferentially and radially and even possibly axially uncoupled from the door shaft and only elastically connected, especially in the form of transmission or chain wheels. The present invention accordingly comprises elastic uncoupling of the driving component of a torque transmission from its driven component to the extent that torque is transmitted from an input shaft to an output shaft precisely not in the manner of a rigid lever but elastically attenuated. It is for this purpose that an elastic connection is provided between the bearings accommodating the driving and the driven components that also allows to a certain extent angular motion within a plane perpendicular to the driving and driven axes.

The advantages of the elastic torque-transmission component in accordance with the present invention over the conventional torque-transmission disclosed in WO 94/00665 are to be found in the gentle treatment of the door and of the driving-motor assembly resulting from the absorption of impacts and in the smooth operation of the door.

BRIEF DESCRIPTION OF THE DRAWINGS

Examples of the present invention will now be specified with reference to the accompanying drawing, wherein.

DESCRIPTION OF THE PREFERRED EMBODIMENTS

Figure 1:
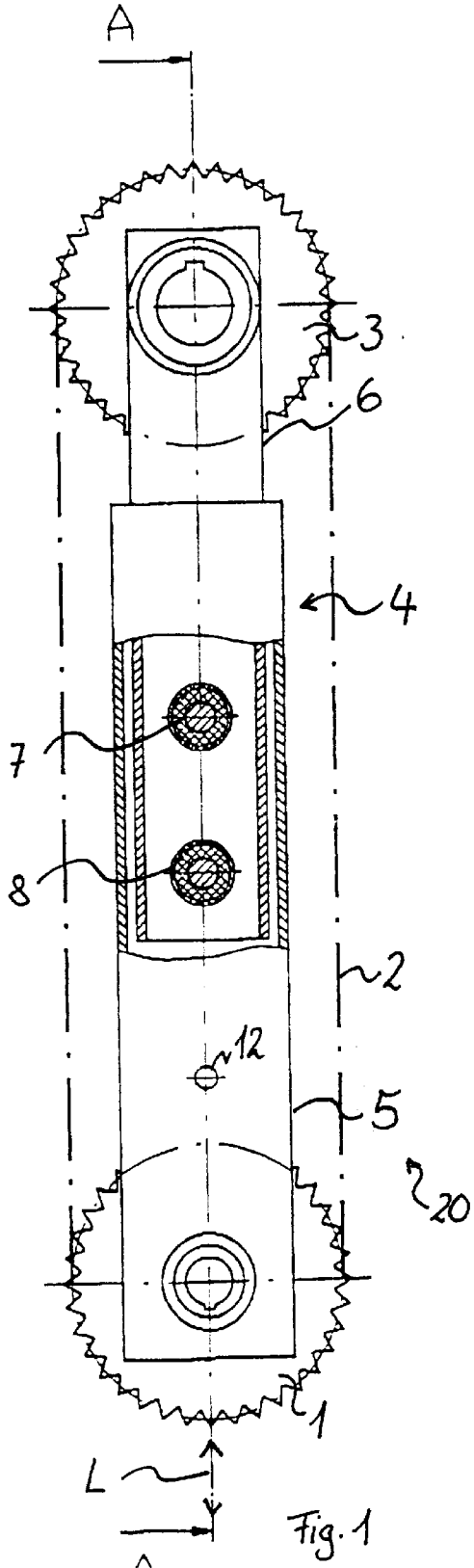
FIG. 1 illustrates a door driving-mechanism torque transmission employed to transmit torque from the output shaft of a geared motor to a door shaft attached to a door that is to opened and closed.
Figure 2:
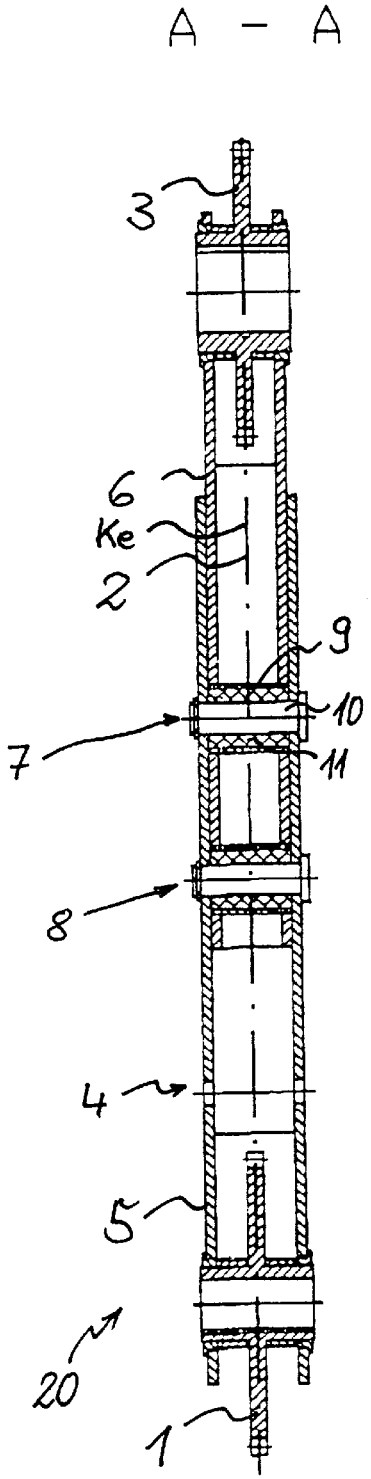
FIG. 2 is a section along the line A—A in FIG. 1.

The door driving-mechanism torque transmission 20 illustrated in FIG. 1 comprises a driving component in the form of a chain-driving wheel 1, tractioning means in the form of a continuous chain 2, and a driven component in the form of a chain-driven wheel 3. The chain 2 couples chain-driving wheel 1 to chain-driven wheel 3. Chain-driving wheel 1 and chain driven wheel 3 are accommodated in a bearing mechanism that because of its shape and function will be referred to as chain "bone 4" hereinafter. It constitutes an elastic strut between wheels 1 and 3.

Bone 4 comprises two lengths of rectangular section, an outer length 5 and an inner length 6 loosely accommodated partly inside it. Chain-driving wheel 1 rotates at the outer end of outer length 5, which accordingly acts as a driving-component bearing half, and chain-driven wheel 3 rotates at the outer end of inner length 6, which accordingly acts as a driven-component bearing. The gap between lengths 5 and 6 allows either to deflect in either direction relative to one another within the chain's plane Ke by rotating out of their illustrated positions around the associated axes of wheels 1 and 3. The bone's elasticity also allows lengths 5 and 6 to slide together and apart to some extent along longitudinal axis L. The elastic attachment between lengths 5 and 6 is embodied in two points 7 and 8 of attachment, each comprising a steel bushing 9 fastened to inner length 6 for example and accommodating an engaging component in the form for example of a pin 10 fastened to outer length 5, steel bushing 9 being separated from pin 10 by a resilient component in the form for example of a rubber bushing 11. Different types of rubber bushing can be employed to vary the elasticity of the attachment within chain bone 4. Rubber bushings of different widths and/or Shore hardnesses can be employed for this purpose for example. The installer and/or manufacturer of the torque transmission can select appropriate pairs of bushings from an unillustrated assortment.

One of the lengths, outer length 5 for example, can be mounted against a driving-mechanism housing that accommodates a door-driving motor assembly, a gear motor for example. Such a housing will be specified hereinafter with reference to FIG. 3. The present embodiment is provided with a threaded bore 12 for this purpose. Other, unillustrated, embodiments, can be provided with several uniformly distributed bores in lengths 5 and 6, allowing the elastic attachment to be established at various incremental distances from the driving and driven components as desired. The overall door driving mechanism torque transmission 20 is also provided with an unillustrated transmission housing to protect it from contamination and external forces and prevent damage. Since it is mounted against and fastened to the length 6 of chain bone 4 that is not connected to the motor, this housing is not coupled to the driving-motor assembly. This arrangement eliminates the loud noise that would be experienced if the motor assembly were accommodated in a housing rigidly fastened to the overall housing and accordingly constituting a resonating body.

Figure 3:
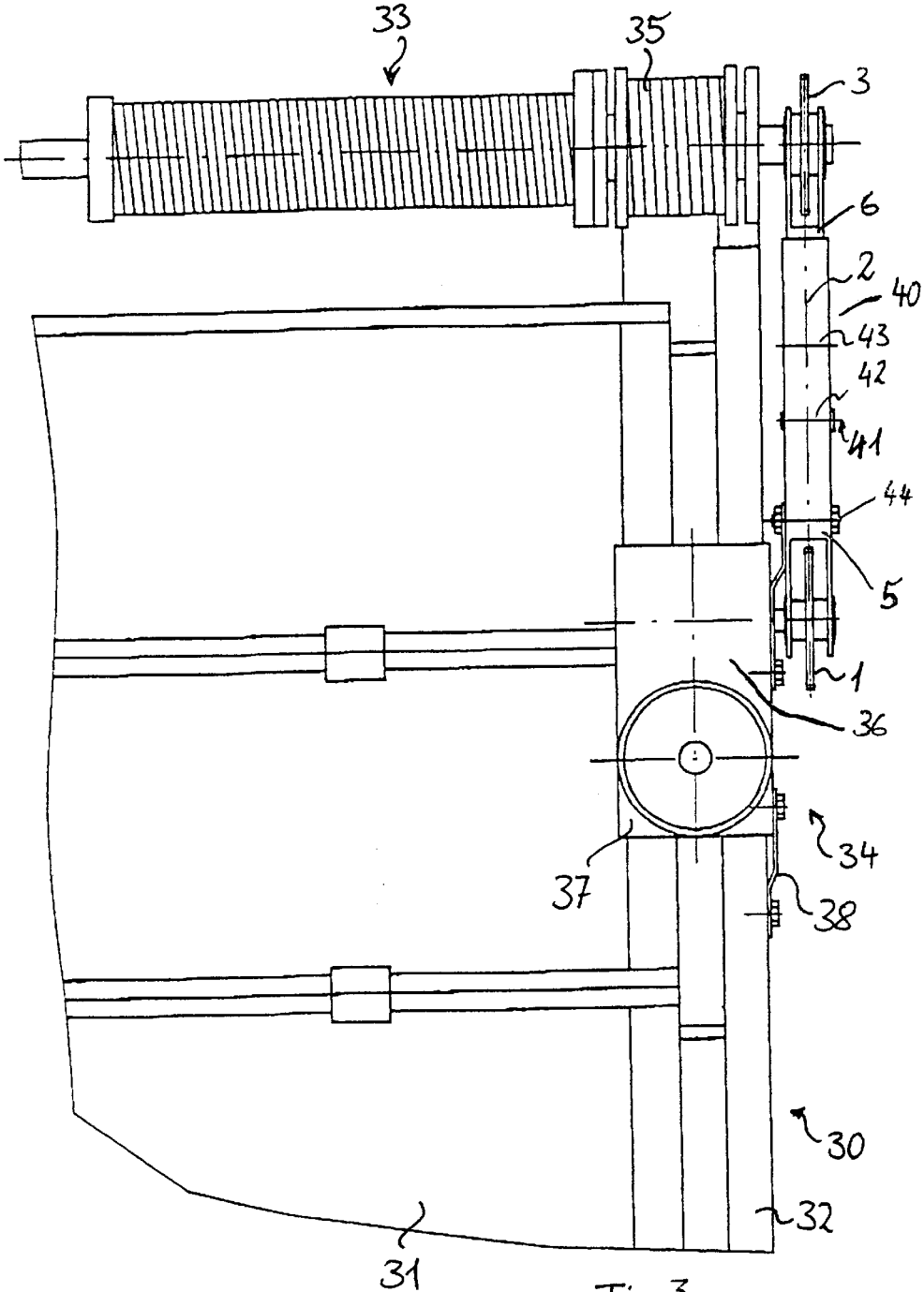
FIG. 3 is a rear view of part of a door provided with another embodiment of the door-driving mechanism with a door driving-mechanism torque transmission.

FIG. 3 illustrates a sectional door 30 with panels 31, a doorcase 32, a spring-torsioned shaft 33, and a door-driving mechanism 34. Spring-torsioned shaft 33 is conventionally connected to a panel 31 by a cable wound around a drum 35.

Door-driving mechanism 34 is provided with a door-driving motor assembly in the form of a geared motor 36 and with door driving-mechanism torque transmission 20 or, in the embodiment illustrated in FIG. 3, a door driving-mechanism torque transmission 40. Motor 36 itself is provided with a worm gear that disengages automatically in an emergency. Door-driving mechanism 34 opens and closes the door by way of torque transmission 40, spring-torsioned shaft 33, and drum 35. Geared motor 36 is provided with a driving-mechanism housing 37 fastened stationary to doorcase 32 by a fastener 38. Torque transmission 40 differs from torque transmission 20 only in the connection between lengths 5 and 6, and similar components are identified by the same reference numbers. The lengths 5 and 6 in torque transmission 40 are attached together by only one elastic point of attachment 41, identical in structure with either of the points 7 and 8 of attachment in torque transmission 20. Lengths 5 and 6 can accordingly be pivoted relative to each other and in opposition to an unillustrated resilient component in the form of a compression spring accommodated between them and around an axis 42 established by attachment 41. Another bore 43 through outer length 5 allows an alternative position for pin 10 and hence attachment 41. A threaded fastener 44 allows outer length 5 to be fastened to driving-mechanism housing 37 at any desired point.

Figure 4:
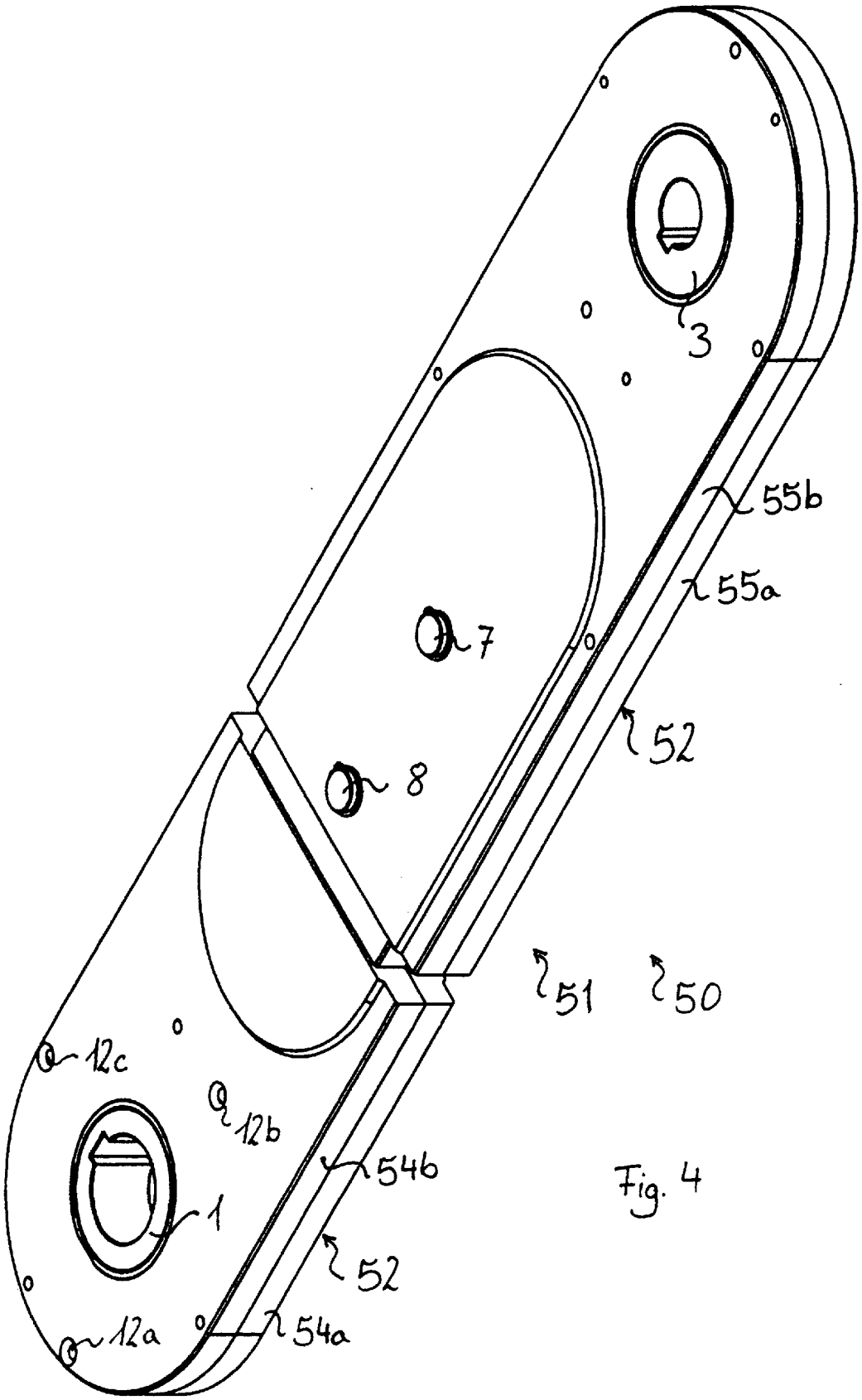
FIG. 4 is a perspective view of still another embodiment of a door driving-mechanism torque transmission to be employed with a door-driving mechanism.
Figure 5:
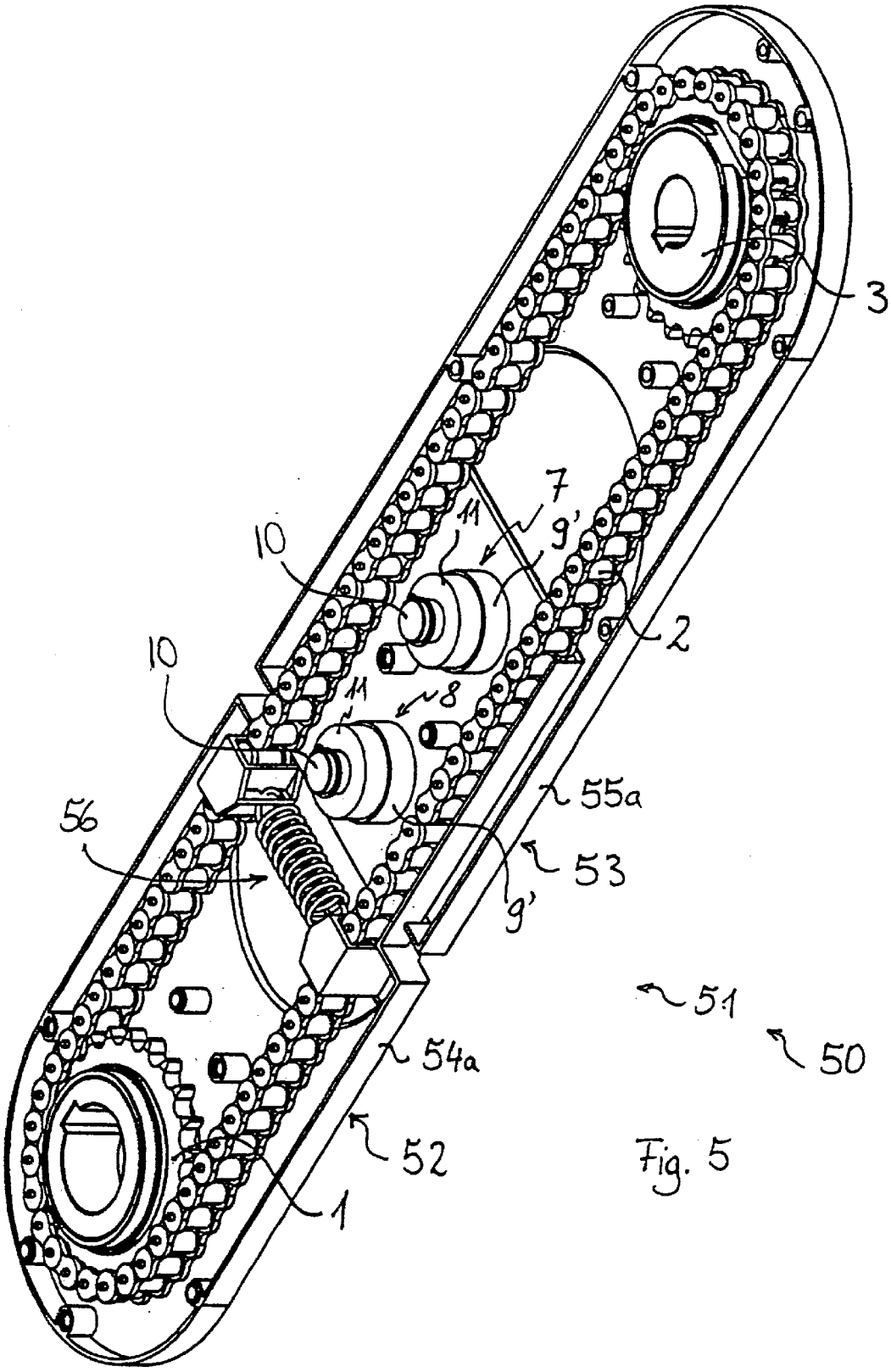
FIG. 5 is a perspective view of the door driving-mechanism torque transmission illustrated in FIG. 4 with one half of the housing removed.

A third embodiment, particularly preferred at the present time, of a door driving-mechanism torque transmission for transmitting torque from a door-driving motor assembly, especially a geared motor, to a shaft connected to a door panel will now be specified with reference to FIGS. 4 and 5. Again, similar components will be identified by the same reference numbers.

Door driving-mechanism torque transmission 50 is essentially similar in design and operation to torque transmission 20. The driving and driven components, however, are not mounted on lengths 5 and 6 of a chain bone 4 but on the halves of a transmission housing 51 that also protects the chain. Transmission housing 51 comprises two separate and uncoupled halves, connected together only elastically, specifically a driving-component bearing half 52 and a driven-component bearing half 53. Bearing halves 52 and 53 comprise two essentially identically designed and mirror-symmetric housing shells 54*a* & 54*b* and 55*a* & 55*b* respectively. Each pair accommodates and acts as a bearing for a chain-driving wheel 1 or 2. Like lengths 5 and 6, they overlap and are separated by a gap of a few millimeters. Bearing half 52 is provided with bores 12*a*, 12*b*, and 12*c* for attachment to the driving mechanism housing 37 of a geared motor 36 like the one illustrated in FIG. 3. Bearing halves 52 and 53 are attached together at elastic points 7 and 8 of attachment and can accordingly both pivot elastically and slide toward and away from each other parallel in particular to the plane of the chain and perpendicular to the axes of rotation of chain wheels 1 and 3.

FIG. 5 illustrates transmission 50 with shells 54*b* and 55*b* removed. Chain 2 extends inside bearing halves 52 and 53 and outside points 7 and 8 of attachment. A tensioning component tensions the two strands of the chain by drawing them together elastically. Points 7 and 8 of attachment are in this embodiment constituted by bushings 9' integrated into the shells 55*a* and 55*b* of driven-component bearing half 53, by pins 10 that can be attached to the shells 54*a* and 54*b* of driving-component bearing half 52, and by a rubber liner 11 between each pin and its associated bushing. Wheels 1 and 3 are conventional and commercially available, and the output shaft of geared motor 36 and the spring-torsioned shaft that engages the wheel is adapted to them.

In operation, with, as with the torque transmission 40 illustrated in FIG. 3, torque transmission 50 interposed between door shaft 33 and geared motor 36, torsional vibrations and impacts and misalligned rotations on the part of the shaft will be accommodated by the relative motions and in particular by the relative pivoting motions of bearing halves 52 and 53 by way of points 7 and 8 of attachment. This feature will protect not only the door itself but also geared motor 36 and torque transmission 50.

The Shore hardnesses of rubber liners 11 can range approximately from 50 to 100, and a hardness of 90 is particularly preferred.

What is claimed is:

1. A motorized door-driving mechanism driving a panel by way of a spring torsioned door shaft in an overhead door, comprising a door-driving motor assembly with a geared motor; a door driving-mechanism torque transmission transmitting torque from said door-driving motor with said geared motor to said door shaft connected to said door panel; comprising the door-driving mechanism a driving component rotating around a first axis and engaged with said geared motor; a driven component rotating around a second axis and engaged with said door shaft a bearing assembly wherein said driving component and said driven component are mounted on separated axes of rotation; a coupling connection between both components; said bearing assembly having a driving component bearing half mounting said driving component, a driven component bearing half separated from said driving component half and mounting said driven component, said bearing halves being connected elastically for attenuating torsional vibrations and impacts.

2. The motorized door driving-mechanism and overhead door as defined in claim 1, wherein both bearing halves are elastically connected together at a distance apart.

3. The motorized door driving-mechanism and overhead door as in claim 1, wherein both bearing halves are elastically connected such that they are movable straight or at an angle toward and away from each other at least within a plane perpendicular to at least one of the two axes of rotation.

4. The motorized door driving-mechanism and overhead door as defined in claim 1, wherein said bearing halves are elastically connected at at least two separated points of attachment.

5. The motorized door driving-mechanism and overhead door as defined in claim 4, wherein said points of attachment comprise separated connecting blocks of an elastic material connecting said bearing halves.

6. The motorized door driving-mechanism and overhead door as defined in claim 1, including a plurality of elastic components for connecting the two bearing halves together and having different elastic properties, deriving from different hardnesses and various dimensions and allowing specific adjustment of rigidity and torsional-vibration attenuation characteristics for selecting particular ones of said elastic components.

7. The motorized door driving-mechanism and overhead door as defined in claim 1, wherein both said bearing halves are elastically coupled, and in mutually telescopically engagement for allowing relative angular motion with play; and a torque-transmission housing comprising two identical and mutually connected housing shells.

8. The motorized door driving-mechanism and overhead door as defined in claim 7, including a coupling is in the form of at least one continuous tractioning means and a wheel engaging each said driving component and driven component with said tractioning means.

9. The motorized door driving-mechanism and overhead door as defined in claim 8, including transmission means comprising said at least one tractioning means and said wheel enclosed in said housing shells and comprising said torque-transmission housing and tensioning means drawing two strands of said tractioning means together inside said transmission housing.

10. The motorized door driving-mechanism and overhead door as in claim 1, including a stationary driving-mechanism housing accommodating said geared motor, said driving component bearing half being disengaged from the driving-mechanism housing due to the elastic connection between said bearing halves for attenuating torsional vibrations and impacts.

11. The motorized door driving-mechanism and overhead door as defined in claim 8, wherein said tractioning means comprises a chain.

12. The motorized door driving-mechanism and overhead door as defined in claim 8, wherein said tractioning means comprises a cogged band.

13. The motorized door driving-mechanism and overhead door as defined in claim 8, wherein said tractioning means comprises a belt.

14. A motorized door-driving mechanism driving a door panel by way of a wind-up shaft in a roll-up door assembly, comprising a door-driving motor assembly; a door driving-mechanism torque transmission transmitting torque from said door-driving motor with said geared motor to said door shaft connected to said door panel, the door-driving mechanism comprising a driving component rotating around a first axis and engaged with said geared motor; a driven component rotating around a second axis and engaged with said door shaft, a bearing assembly wherein said driving component and said driven component are mounted on separated axes of rotation; a coupling connection between both components; said bearing assembly having a driving component bearing half mounting said driving component, a driven component bearing half separated from said driving component half and mounting said driven component, said bearing halves being connected elastically for attenuating torsional vibrations and impacts.

15. A motorized door-driving mechanism driving a door panel between an open position and a closed position by way of a spring torsioned door shaft in a sectional door assembly, connected to said panel and driving said panel comprising a door-driving motor assembly with a geared motor; a door driving-mechanism torque transmission for transmitting torque from said door-driving motor with said geared motor to said door shaft connected to said door panel, the door-driving mechanism comprising a driving component rotating around a first axis and engaged with said geared motor; a driven component rotating around a second axis and engaged with said door shaft, a bearing assembly wherein said driving component and said driven component are mounted on separated axes of rotation; a coupling connection between both components; said bearing assembly having a driving component bearing half mounting said driving component, a driven component bearing half separated from said driving component half and mounting said driven component said bearing halves being connected elastically for attenuating torsional vibrations and impacts.

* * * * *